United States Patent [19]

Chew et al.

[11] Patent Number: 4,533,084

[45] Date of Patent: Aug. 6, 1985

[54] METHOD FOR COMMINUTING BITUMINOUS COAL USING AN AQUEOUS METHANOL SOLUTION

[75] Inventors: Ju-Nam Chew; Joseph G. Savins, both of Dallas, Tex.

[73] Assignee: Mobil Oil Corporation, New York, N.Y.

[21] Appl. No.: 485,527

[22] Filed: Apr. 15, 1983

[51] Int. Cl.[3] ..... B02C 19/00

[52] U.S. Cl. ..... 241/1; 241/21; 241/29; 299/5

[58] Field of Search ..... 406/197, 154; 299/4, 299/5; 166/307, 308; 241/1, 21, 24, 29

[56] References Cited

U.S. PATENT DOCUMENTS 3,815,826 6/1974 Aldrich et al. ..... 241/1

4,400,034 8/1983 Chew ..... 241/1

OTHER PUBLICATIONS

"Application of . . . Particle Coal", Lawler et al., 3-1978.

*Primary Examiner*—Mark Rosenbaum

*Attorney, Agent, or Firm*—Alexander J. McKillop; Michael G. Gilman; Charles A. Malone

[57] ABSTRACT

This invention is a process for comminuting run-of-mine crushed coal by contacting the coal with an aqueous methanol solution for a time sufficient to comminute a substantial portion of the coal to a predetermined particle size. Another aspect of this invention is a process for slurry mining coal which comprises contacting the coal in-situ with an aqueous methanol solution for a time sufficient to comminute a portion of the coal and to form a slurry, and then conveying the slurry to a receiving vessel where the comminuted coal is recovered. Still another aspect of this invention, is to transport the comminuted coal having a desired particle size in slurry form using an aqueous methanol solution as the slurry medium wherein there is further comminution of the coal to improve its burning characteristics.

20 Claims, 1 Drawing Figure

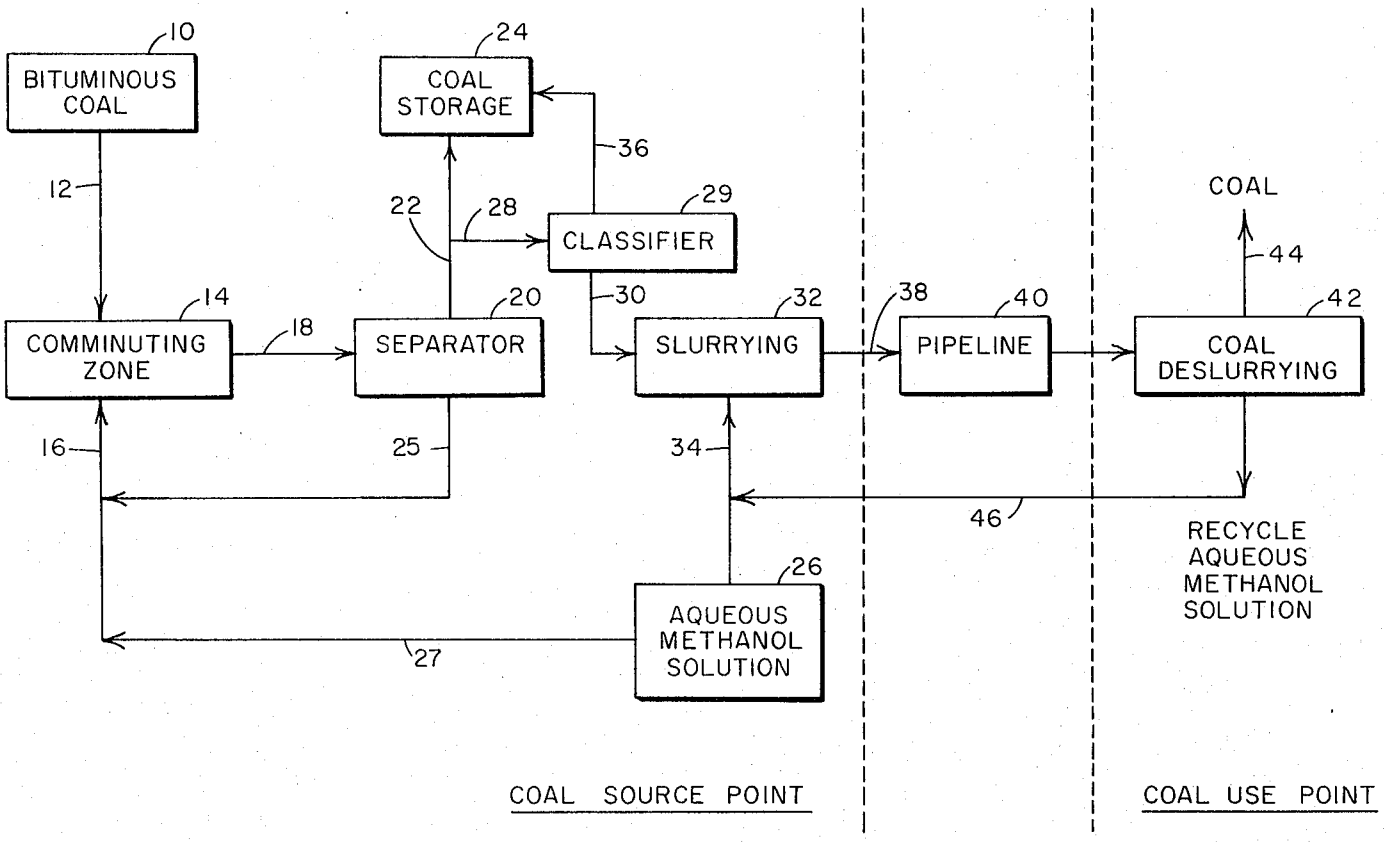
BITUMINOUS COAL
10
12
COMMINUTING ZONE
14
16
18
SEPARATOR
20
22
25
27
COAL STORAGE
24
28
CLASSIFIER
29
30
36
SLURRYING
32
34
AQUEOUS METHANOL SOLUTION
26
PIPELINE
38
40
46
COAL DESLURRYING
42
44
COAL
RECYCLE AQUEOUS METHANOL SOLUTION
COAL USE POINT
COAL SOURCE POINT

METHOD FOR COMMINUTING BITUMINOUS COAL USING AN AQUEOUS METHANOL SOLUTION

BACKGROUND OF THE INVENTION

The invention relates to a method for comminuting bituminous coal and transporting comminuted coal having a desired particle size in a slurry form. In particular, the invention provides the use of an aqueous methanol solution for comminuting the coal and as the slurry medium.

As the result of the declining availability of oil, more emphasis has been directed toward the problem of more effective utilization of coal. Two methods are generally used for removing coal from the ground, either strip mining, in which the coal is merely dug out of the ground by mechanical or hydraulic means and transferred to the place of use, or underground mining using methods such as slurry mining, room and pillar, or long wall.

Comminution of coal into pieces of manageable size has been accomplished by mechanical means, explosives or by chemical means.

Processs for chemical comminution of coal, both above ground and below ground have been disclosed in U.S. Pat. Nos. 3,815,826 to Aldrich et al, 3,870,237 to Aldrich and 4,032,193 to Drinkard et al. According to these processes, the interlayer forces at natural interfaces present in the coal is weakened by contact with a number of reagents such as gaseous anhydrous ammonia, liquid anhydrous ammonia, aqueous ammonia, organic solvents, alcohols containing sodium hydroxide, and aqueous solutions of sodium hydroxide.

More recently, it has been proposed to transport coal by pumping it as a slurry through a pipeline using water, methanol, or liquid carbon dioxide as the slurry medium, see U.S. Pat. No. 4,206,610 to Santhanam.

The present invention uses an aqueous methanol solution to comminute run-of-mine crushed bituminous coal and thereafter coal particles having a selected particle size are slurried using an aqueous methanol solution as the slurry medium to provide a stable slurry pumpable through a main slurry pipeline to a coal use point resulting in a coal having improved burning characteristics due to further comminution of the coal during pumping.

SUMMARY OF THE INVENTION

This invention is a process for comminuting run-of-mine crushed bituminous coal comprising contacting the coal with an aqueous methanol solution containing 10 to 90 volume percent methanol, preferably 50 to 75 volume percent, for a time sufficient to comminute a substantial portion of the coal to a top size of 14 mesh (Tyler). Coal particles having a desired particle size, preferably sized to pass a 14 mesh screen, are slurried with an aqueous methanol solution to form a stable coal/aqueous methanol solution slurry that is pumpable.

BRIEF DESCRIPTION OF THE DRAWING

The drawing is a flow diagram of one embodiment of this invention.

DESCRIPTION OF THE PREFERRED EMBODIMENTS

Referring to the drawing, run-of-mine crushed bituminous coal, preferably 1½ to 2 inches in particle diameter, at a coal source point 10 is transported via line 12 to a comminuting zone 14 where it is contacted with an aqueous methanol solution introduced via line 16 for a sufficient time to comminute a substantial portion of the coal to a particle size below 14 mesh. Depending upon the concentration of methanol in the mix, contact time in the comminuting zone 14 can range from several hours to several days at room temperature. The concentration of methanol in the solution is within the range of 10 to 90 volume percent, preferably 50% to 75% by volume. The amount of aqueous methanol solution needed to effectively comminute the bituminous coal in the comminution zone 14 is within the range of 0.3 part to about 3 parts by weight of solution per part of coal and preferably 1 part by weight of solution per part of coal.

Thereafter, the aqueous methanol solution containing comminuted coal is passed via line 18 to a separator 20 which separates the comminuted coal from the aqueous methanol solution. The comminuted coal is removed from the separator 20 via line 22 and transferred to a coal storage bin 24 if the coal is to be used for burning at the coal source point. Aqueous methanol solution is recovered from the separator 20 via line 25 and recycled to the comminuting zone 14 via 16. Since there is a net loss of aqueous methanol solution, i.e. the fraction of solution not recoverable or sbsorbed by coal, makeup aqueous methanol solution from tank 26 is introduced to the comminuting zone 14 via line 27 and 16 to maintain the desired weight ratio of solution to coal and the desired methanol concentration in the solution as previously described. Tank 26 can deliver an aqueous methanol solution of any desired concentration.

If it is desired to transport the comminuted coal as a slurry though a main pipeline from the coal source point to a distant coal use point the optimum degree of comminution (resultant size distribution) of the coal, between the mine and the end use point, and the proportions (and makeup) of the suspending phase (vehicle) will be determined by design tradeoffs peculiar to the specific application, the initial moisture content of the coal, and the method of coal transport selected. For example, the objective may be to prepare a fully comminuted coal/aqueous methanol slurry near the mine which is pumped to the coal use point. In this instance, application to coal transport by the "conventional" coal slurry will require comminution to less than 14 mesh (Tyler) top size with about 20% smaller than 325 mesh (Tyler); reasonable solids content is between 39% (wt.) and 60% (wt.), with 50% (wt.) a reasonable design value. For application to the "stabilized slurry" concept described by Williams Brothers Engineering Company (3rd Int'l. Tech. Conf. on Slurry Transportation, Las Vegas, Nevada, Mar. 29–31, 1978) a reasonable size distribution by comminution is top size (14 mesh), smaller than 100 mesh (40–42%), and smaller than 325 mesh (19%); reasonable proportions are 35% vehicle to 65% coarse coal (¾"×28 mesh), at 70% (wt.) coal. For application to the special vehicle process described by Savins in U.S. Pat. No. 4,305,688, a reasonable size distribution by comminution is about 98% passing 14 mesh and about 20% smaller than 325 mesh; reasonable proportions are 40% (wt.) to 70% (wt.) coal solids and a liquid vehicle comprised of a mix of methanol, 15 to 75% (wt.) water, and at least 0.1% (wt.) of a polymer selected from the list disclosed in subject patent.

If it is desired to utilize one of the coal slurry pipeline approaches described above, the comminuted coal recovered from separator 20 via 22 is introduced via line 28 into a classifier 29 where coal of the required size distribution (as determined above) is recovered and introduced via line 30 to a slurrying zone 32 to form a pumpable slurry with aqueous methanol solution from tank 26 via line 34. Coal particles larger than 14 mesh are withdrawn from classifier 29 via line 36 and transferred to coal storage bin 24. If desired, polymers from the group disclosed in U.S. Pat. No. 4,305,688 may be introduced at this point. Useful polymers include additives selected from the group consisting of hydroxyethyl cellulose, carboxymethyl hydroxyethyl cellulose, polyethylene oxide, and mixtures thereof, in amounts of at least 0.1% (wt.) with the vehicle.

To further stabilize the slurry, i.e. to prevent the subsidence and compaction of the coal particles so that the slurry can be transmitted and stored for extended period of time and remain pumpable, surfactants and polymers may be added to the liquid medium in an amount required to make the proper consistency of the final slurry. Suitable surfactants include anionic or cationic surfactants, and preferably non-ionic or ampholytic surfactants. Suitable non-ionic surfactants containing oxyalkylene groups are described in U.S. Pat. Nos. 3,048,548; 3,442,242; 3,314,891; 3,959,968; 3,933,670 and the like. The surfactant can be employed effectively in a quantity of 0.005 to 1 weight percent based on the total weight of the coal composition.

As indicated above, a stable slurry suitable for pumping may contain from 39% (wt.) to 70% (wt.) coal suspended in a vehicle containing from 10% (vol.) to 90% (vol.) methanol together with polymeric and surfactant additives.

The coal/aqueous methanol solution slurry from zone 32 is then pumped via line 38 through a main slurry pipeline 40 to the point of coal use where the aqueous methanol solution is separated from the coal by deslurrying in zone 42. The step of deslurrying is accomplished by conventional dewatering equipment such as by solid bowl centrifuges or liquid-solid cyclone separators. Throughout this operation a portion of the methanol in the slurry medium will be adsorbed into the coal particles thereby promoting the ignition and combustion properties of the coal. The deslurried coal having improved burning characteristics is recovered via line 44 for burning at the coal use point.

Depending upon the economic penalty involved, the vehicle may be returned by a recycle pipeline (or other suitable means) to the upstream end for reuse. In the case of the "conventional" coal slurry, the vehicle will be essentially methanol-water together with coal fines. In the case of the "stabilized slurry", as previously described, the vehicle will consist of a selected size distribution of fine ground coal suspended in methanol-water. In the case of the special vehicle disclosed by U.S. Pat. No. 4,305,688 previously discussed, the vehicle will be essentially methanol-water together with some polymer and surfactant, and coal fines. The vehicle solution recovered from the deslurrying zone 42 is returned to the slurrying zone 32 via line 46 and 34 for use in reforming slurry.

In still another embodiment of the present invention, the process may be employed to mine coal in-situ wherein an aqueous methanol solution containing 10 to 90 volume percent methanol, preferably 50 to 75 volume percent, is injected into a subterranean or strippable coal seam to break up the coal and form a resulting slurry which is pumped to the surface to a receiving vessel. A suitable method for comminuting and recovering the coal in-situ in accordance with this technique is described in U.S. Pat. No. 4,032,193 to Drinkard et al, the disclosure of which is hereby incorporated by reference. The coal in the coal/aqueous methanol solution slurry at the receiving vessel is maintained in contact therewith for a sufficient time to comminute a substantial portion of the coal to a desired fineness. The comminuted coal is recovered and a portion of the comminuted coal having the desired particle size may be slurried as previously described.

This invention will be further illustrated by the following specific examples:

EXAMPLE 1

The specificity of comminution reactively for coal rank when using methanol is illustrated by the following example:

Plugs 1 inch dia.×0.25 inch thick were cut from samples of low rank coals from a prospect near Buffalo, Wyoming. Specimens cut normal as well as parallel to the bedding planes were prepared and placed in individual beakers containing methanol at room temperature. A sample of a high rank coal from Catlinville, Ill. area was also selected and immersed in methanol. These specimens were left undisturbed for periods ranging from 1 day to 80 days and the degree of natural comminution recorded at frequent intervals. The results are summarized below:

TABLE 1

EFFECT OF COAL RANK ON COMMINUTION REACTIVITY IN 100% METHANOL

| | | DEGREE OF COMMINUTION AT INDICATED TIME (DAYS) | | | |
|---|---|---|---|---|---|
| RANK | SOURCE | 0.67 | 1 | 50 | 73 |
| bituminous | Illinois No. 6 | Fragmented | — | — | — |
| subbituminous "C" | Ucross | Intact | → | → | → |
| lignite | Cameron | Intact | → | → | → |
| lignite | Healy | Intact | → | → | → |

The above results show that in the case of bituminous coal, less than 1 day elapsed for significant breakage to occur with formation of coal fragments. It was observed this comminution resulted without any apparent change in the appearance of the methanol. Simply touching the coal produced additional fragmentation. By contrast, with the lower rank coals, after 73 days contact with 100% methanol, the only evidence of reactivity was a slight yellowish discoloration imparted to the alcohol. Thus the absence of comminution in undiluted methanol shows that only the higher rank coal is suitable for the process disclosed here.

EXAMPLE 2

The comminution reactively of a high rank coal as a function of the proportion of alcohol in an alcohol-water mixture is illustrated by the following example:

Specimens approximately 1.5 inch×1 inch×1 inch were cut from a larger sample of Illinois No. 6 coal, immersed in solutions containing from 5% (vol.) methanol to 100% (vol.) methanol, and left undisturbed for several days. Comminution reactivity was observed at a standardized time of 3 days immersion; however fragmentation was evident at short times for solutions containing more than 10% (vol.) methanol. Results were analyzed in terms of a "Fragmentation Index" in which strong reactivity was given a rank of 10 and very weak reactivity was given a rank of 1. The results are summarized below:

TABLE 2

| COMMINUTION REACTIVITY OF BITUMINOUS COAL IN AQUEOUS METHANOL SOLUTIONS | |
|---|---|
| VOL. % ALCOHOL IN MIX | FRAGMENTATION INDEX |
| 5 | 1 |
| 10 | 3 |
| 25 | 3 |
| 50 | 6 |
| 75 | 10 |
| 90 | 5 |
| 100 | 7 |

The above results show that fragmentation of bituminous coal occurs over a broad range of methanol concentrations, with substantial comminution occurring when the aqueous methanol solution contains about 75% by volume alcohol. However, fragmentation is also occurring when the alcohol content is of the order of 10% by volume.

Obviously, many other variations and modifications of the invention as having before set forth may be made without departing from the spirit and scope of this invention, as those skilled in the art will readily understand. Such variations and modifications are considered to be within the purview and scope of the appended claims.

What is claimed is:

1. A method for comminuting bituminous run-of-mine crushed coal comprising contacting said coal in a comminution zone with an aqueous methanol solution of a strength of about 51 to about 75 volume percent sufficient to give substantially better comminution reactivity than substantially anhydrous methanol and maintaining said contact for a time sufficient to comminute a substantial portion of said coal to a predetermined particle size.

2. The method of claim 1 wherein a substantial portion of said coal is reduced to a particle size below 14 mesh.

3. The method of claim 1 wherein the ratio of aqueous methanol solution to coal is within the range of 0.3 to 3 parts by weight of solution per part of coal.

4. The method of claim 1 further including the step of separating the comminuted coal from the aqueous methanol solution and recycling the aqueous methanol solution to the comminution zone.

5. The method of claim 1 wherein the run-of-mine coal has a particle size within the range of 1½ to 2 inches in diameter.

6. A method for comminuting and transporting run-of-mine crushed bituminous coal comprising the steps of:

(a) contacting said coal with an aqueous methanol solution of a strength of about 51 to about 75 volume percent sufficient to give substantially better comminution reactivity than substantially anhydrous methanol in a comminuting zone and maintaining said contact for a time sufficient to comminute a substantial portion of the coal to a predetermined particle size;

(b) recovering comminuted coal particles from said coal/aqueous methanol solution;

(c) slurrying the comminuted coal particles having a desired particle size with an aqueous methanol solution to form a stable coal/aqueous methanol solution slurry;

(d) pumping said slurry through a pipeline to a coal use point during which time further comminution of the coal particles occur; and (e) deslurrying said coal/aqueous methanol solution slurry at said coal use point to separate said coal and said aqueous methanol solution to provide said coal in condition for burning having improved burning characteristics and a coal-free aqueous methanol solution.

7. The method of claim 6 wherein the weight loading of said finely divided coal in said slurry during step (c) is up to 70 percent.

8. The method of claim 6 including the step of returning the coal-free aqueous methanol solution from step (e) for reuse in forming said slurry according to step (c).

9. The method of claim 6 wherein a surfactant or polymer is added to the aqueous methanol solution during step (a) in an amount sufficient to stabilize the slurry so as to prevent the subsidence and compaction of the coal particles thereby enabling the slurry to be transported and stored for extended periods of time and remain pumpable.

10. The method of claim 9 wherein the surfactant is selected from the group consisting of anionics, cationics, non-ionics, and ampholytics.

11. The method of claim 9 wherein the polymer is selected from the group consisting of hydroxyethyl cellulose, carboxymethyl hydroxyethyl cellulose, polyethylene oxide and mixtures thereof.

12. The method of claim 6 including the step of returning the coal-free aqueous methanol solution of step (b) to the comminution zone.

13. The method of claim 6 wherein the run-of-mine coal has a particle size within the range of 1½ to 2 inches in diameter.

14. The method of claim 6 wherein said comminuted coal particles slurried during step (c) are sized to pass a 14 mesh screen.

15. A method for mining subterranean bituminous coal comprising contacting said coal with an aqueous methanol solution of a strength of about 51 to about 75 volume percent sufficient to give substantially better comminution reactivity than substantially anhydrous methanol and maintaining said contact for a time sufficient to comminute a portion of said coal, injecting additional aqueous methanol solution into the region of the comminuted coal to form a coal/aqueous methanol solution slurry, and transporting said slurry to a receiving vessel.

16. The method of claim 15 further including the step of separating said comminuted coal from said aqueous methanol solution for burning and recycling the aqueous methanol solution for slurry mining.

17. A method of mining subterranean or strippable bituminous coal and transporting said coal comprising the steps of:

(a) contacting said bituminous coal with an aqueous methanol solution of a strength of about 51 to about 75 volume percent sufficient to give substantially better comminution reactivity than substantially anhydrous methanol and maintaining said contact for a time sufficient to comminute a portion of said coal;

(b) injecting additional aqueous methanol solution into the region of the comminuted coal to form a coal/aqueous methanol solution slurry;

(c) transporting said slurry to a receiving vessel;

(d) separating comminuted coal from said aqueous methanol solution in said receiving vessel;

(e) slurrying the comminuted coal particles having a desired particle size with an aqueous methanol solution to form a stable coal/aqueous methanol solution slurry;

(f) pumping said slurry through a pipeline to a coal use point during which time further comminution of the coal particles occur; and (g) deslurrying said coal-aqueous methanol solution slurry at said coal use point to separate said coal and said aqueous methanol solution to provide said coal in condition for burning having improved burning characteristics and a coal-free aqueous methanol solution.

18. The method of claim 17 wherein the comminuted coal particles slurried during step (e) are sized to pass a 14 mesh screen.

19. The method of claim 17 wherein the weight loading of said finely divided coal in said slurry during step (e) is up to 70 percent.

20. The method of claim 17 including the step of returning the coal-free aqueous methanol solution from step (g) for reuse in forming said slurry according to step (e).

* * * * *